US009669522B2

(12) United States Patent
Chen

(10) Patent No.: US 9,669,522 B2
(45) Date of Patent: Jun. 6, 2017

(54) SCREW BOLT DISMANTLING TOOL

(71) Applicant: Jun-Fan Chen, Taichung (TW)

(72) Inventor: Jun-Fan Chen, Taichung (TW)

( * ) Notice: Subject to any disclaimer, the term of this patent is extended or adjusted under 35 U.S.C. 154(b) by 343 days.

(21) Appl. No.: 14/631,135

(22) Filed: Feb. 25, 2015

(65) Prior Publication Data

US 2016/0243681 A1 Aug. 25, 2016

(51) Int. Cl.

| | |
|---|---|
| ***B25B 13/48*** | (2006.01) |
| ***B25B 23/12*** | (2006.01) |
| ***B25B 13/56*** | (2006.01) |

(52) U.S. Cl.

CPC ..... *B25B 13/481* (2013.01); *B25B 23/12* (2013.01)

(58) Field of Classification Search

CPC ..... B25B 13/481; B25B 13/56; B25B 23/12; B25B 13/02; B25B 23/08; B25B 9/00; B25B 11/002

See application file for complete search history.

(56) References Cited

U.S. PATENT DOCUMENTS

| | | | | |
|---|---|---|---|---|
| 3,837,244 | A | 9/1974 | Schera, Jr. | |
| 4,145,939 | A * | 3/1979 | Garrison | B25B 13/06 81/125 |
| 5,572,913 | A | 11/1996 | Nasiell | |
| 6,006,630 | A * | 12/1999 | Vasichek | B25B 23/12 81/125 |
| 7,591,207 | B1 * | 9/2009 | Burkhardt | B25B 13/02 81/125 |
| 9,248,558 | B1 * | 2/2016 | Burkhardt | B25B 23/12 335/285 |
| 2004/0012215 | A1 * | 1/2004 | Chang | B25B 11/002 294/65.5 |
| 2005/0098002 | A1 * | 5/2005 | Holland-Letz | B25B 23/12 81/451 |

* cited by examiner

*Primary Examiner* — David B Thomas

(74) *Attorney, Agent, or Firm* — Muncy, Geissler, Olds & Lowe, P.C.

(57) ABSTRACT

The screw bolt dismantling tool includes a shaft. The shaft has a handle and a working portion at two opposite ends thereof The working portion includes a seat and at least one abutting piece. The seat has a magnet on a central portion of a face of the seat opposite to the handle. The abutting piece is located at a periphery of the face of the seat opposite to the handle and extends toward a direction opposite to the handle. The abutting piece is non-magnetic.

10 Claims, 4 Drawing Sheets

SCREW BOLT DISMANTLING TOOL

BACKGROUND OF THE INVENTION

Field of the Invention

The present invention relates to a tool for dismantling a screw bolt.

Description of the Prior Art

In general, the sump bolt of oil sump is dismantled by a common wrench. However, the sump bolt is located at a position which is not easy to reach. Thus, the wrench may easily slip from the sump bolt. In addition, the common wrench is adapted for bolt in a single size. As a result, a single wrench is unable to be used for dismantling sump bolts in various sizes.

U.S. Pat. No. 3,837,244 and U.S. Pat. No. 5,572,913 disclosed a dismantling tool for dismantling sump bolts having a socket disposed on a bendable shaft. The socket is sleeved onto the head of the sump bolt to rotate it. However, it is difficult to accurately connect the socket onto the sump bolt. In addition, the socket is unable to used for dismantling sump bolts having heads in various sizes or shapes.

SUMMARY OF THE INVENTION

The main object of the present invention is to provide a screw bolt dismantling tool which is able to improve efficiency and to dismantle the screw bolt without touching it by hand.

To achieve the above and other objects, a screw bolt dismantling tool of the present invention includes a shaft. The shaft has a handle and a working portion at two opposite ends thereof The working portion includes a seat and at least one abutting piece. The seat has a magnet on a central portion of a face of the seat opposite to the handle. The abutting piece is located at a periphery of the face of the seat opposite to the handle and extending toward a direction opposite to the handle. The abutting piece is non-magnetic.

Thereby, the magnet is used to adhere onto the top of the screw bolt, and the abutting piece is used to abut against a fringe of the head of the screw bolt. Thereby, the screw bolt can be rotated by the tool. Due to the magnet, the tool may not be slipped from the screw bolt easily. In addition, the abutting piece corresponds to screw bolts in various sizes.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
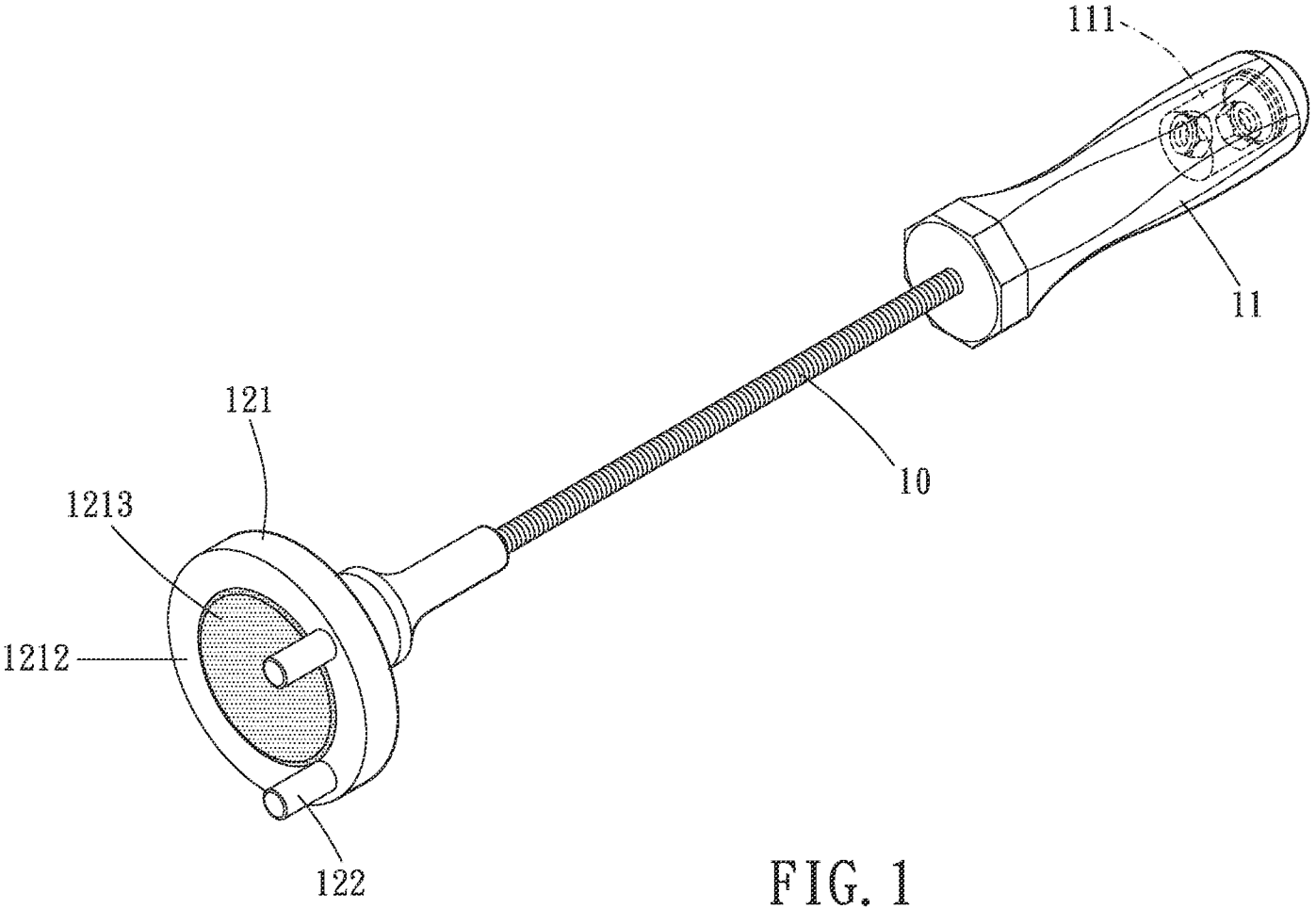
FIG. 1 is a stereogram of the present invention.
Figure 2:
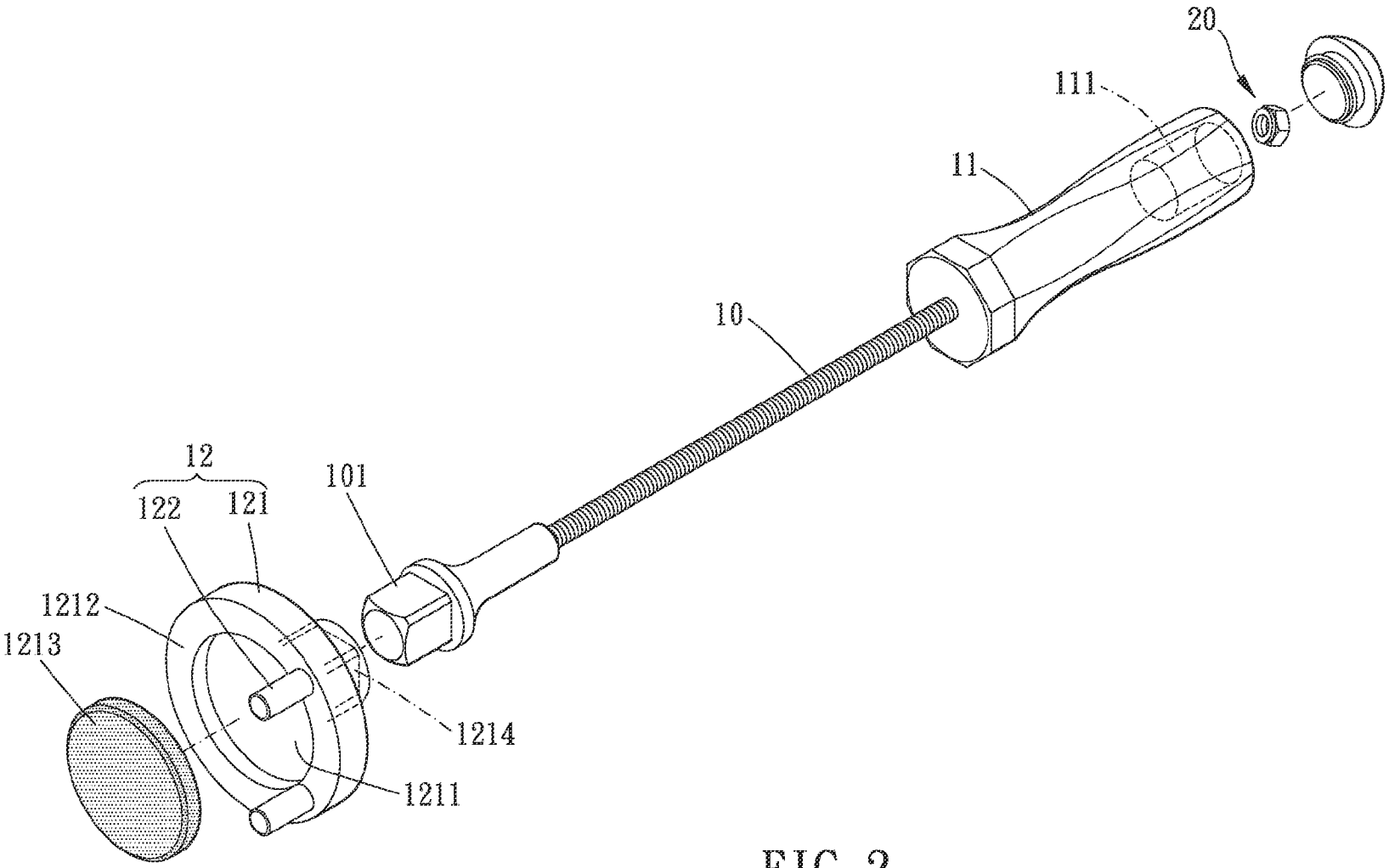
FIG. 2 is a breakdown drawing of the present invention.

Please refer to FIG. 1 to FIG. 5, the screw bolt of the present invention includes a shaft 10 which has a handle 11 and a working portion 12 at two opposite ends thereof The handle 11 is formed with a receiving room 111 at an end thereof apart from the working portion 12. The receiving room 111 is adapted for receiving tools or working pieces 20. In the present embodiment, the shaft 10 is bendable.

The working portion 12 includes a seat 121 and two abutting pieces 122. The seat 121 has a magnet 1213 at a central portion of a face thereof opposite to the handle 11. The two abutting pieces 122 are located at a periphery 1212 of a face of the seat 121 opposite to the handle 11 and extend toward a direction opposite to the handle 11. The two abutting pieces 122 are arranged in interval. An angle between lines defined by each abutting piece 1212 and a center of the seat 121 is an acute angle. The periphery 121 of the face of the seat 121 opposite to the handle 11 and the two abutting pieces 122 are all non-magnetic (including non-magnetic-conductive). For example, the periphery 121 of the face of the seat 121 opposite to the handle 11 and the two abutting pieces 122 can be made of materials such as aluminum alloy, fiber reinforced plastics, or others.

In the present embodiment, the seat 121 is detachably disposed on the shaft 10. Preferably, the seat 121 is formed with a connecting notch 1214 at an end thereof facing the handle 11. The shaft 10 has a protrusion 101 at an end away from the handle 11. The protrusion 101 has a shape corresponding to the connecting notch 1214 to be positioned in the connecting notch 1214 so that the shaft 10 is connected with the seat 121. More specifically, the protrusion optionally includes a ball and a spring pushing the ball, and a positioning notch is formed the inner wall of the connecting notch. When the ball abuts against the positioning notch, the seat can be positioned to the shaft.

Figure 5:
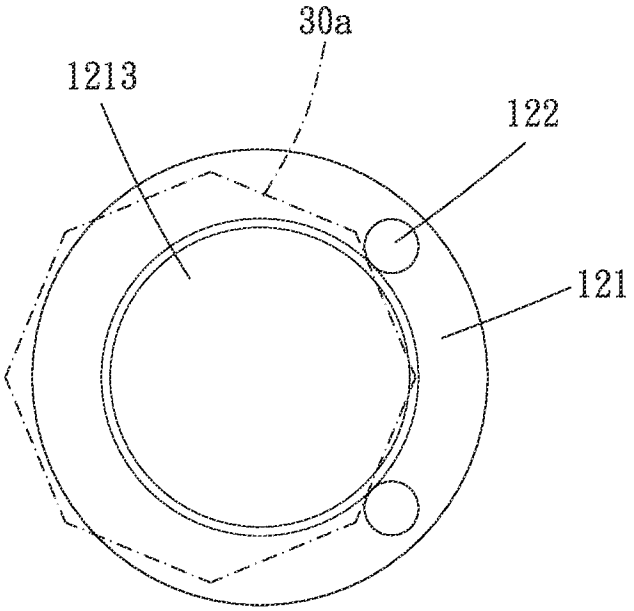
FIGS. 4 and 5 are illustrations of the present invention when used for screw bolts in various sizes.
Figure 4:
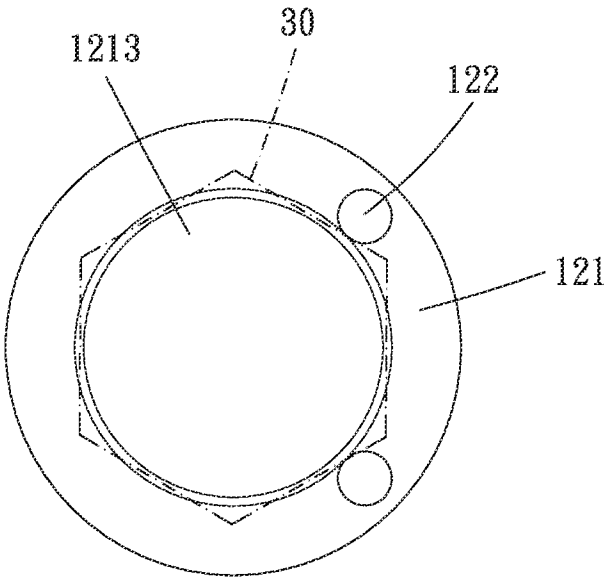

Besides, the seat 121 is formed with a receiving recess 121 at the central portion of the face of the seat 121 opposite to the shaft 10. The magnet 1213 has a shape corresponding to the receiving recess 1211 to be received in the receiving recess 1211. Each abutting piece 122 is preferably column-shaped to fit to screw bolts in various sizes. As shown in FIGS. 4 and 5, the abutting pieces 122 can be used for abutting heads of screw bolts 30, 30*a* in various sizes and shapes.

Figure 3:
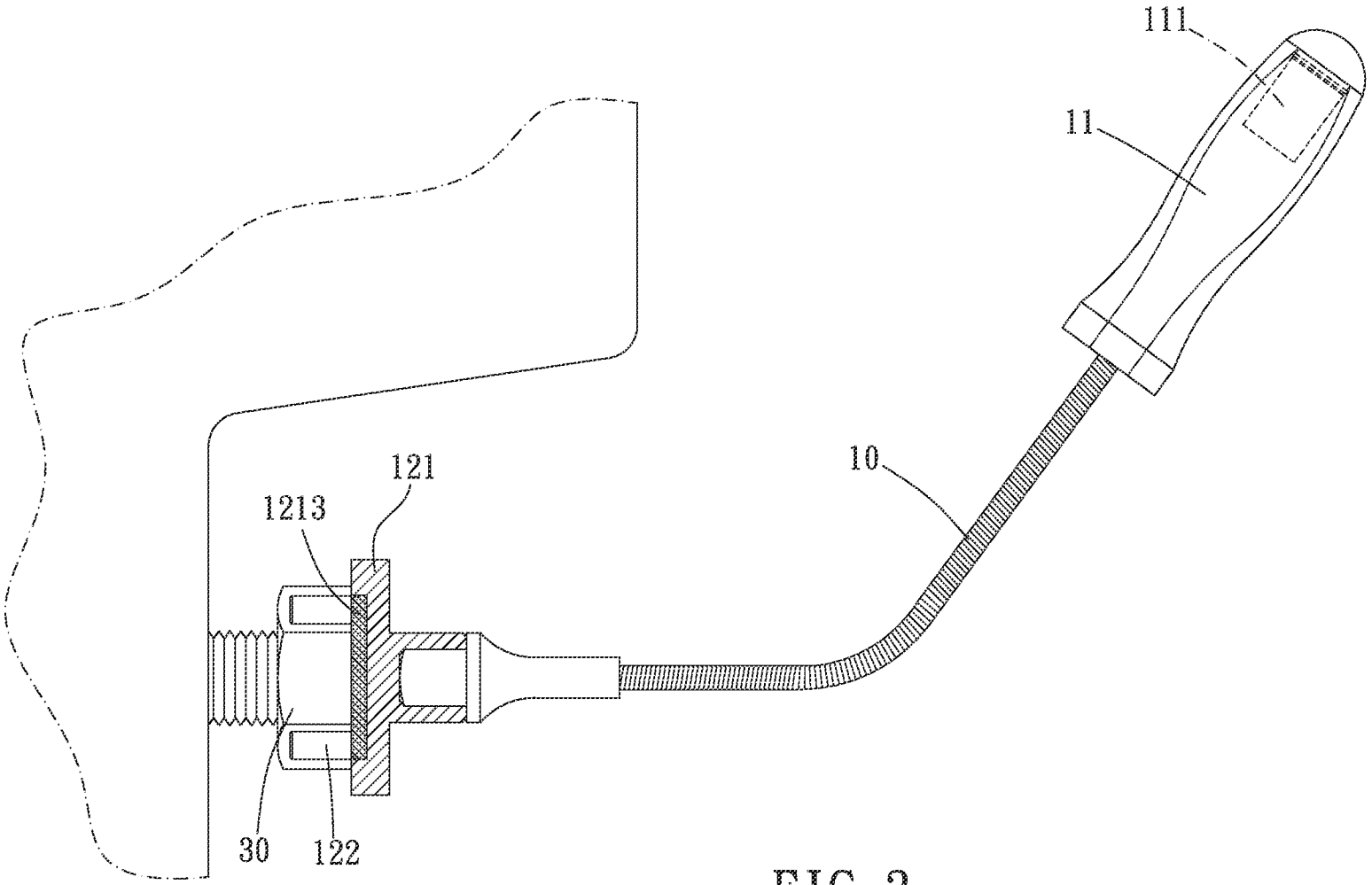
FIG. 3 is an illustration of the present invention.

In use, as shown in FIG. 3, when dismantling a sump bolt (screw bolt) of a oil sump, the magnet 1213 can be used to adhere onto the head of the screw bolt 30 first. And then, the positions of the abutting pieces 122 are adjusted to make sure that the abutting pieces 122 abut against different fringes of the head of the screw bolt 30. Thereafter, the screw bolt 30 can be rotated by the shaft 10. The dismantled screw bolt 30 can be brought out by the magnet 1213. As a result, it is not necessary to touch the greasy screw bolt 30 by hand.

In conclusion, the screw bolt dismantling tool of the present invention can prevent from slipping from the head of the screw bolt due to the magnet, and excess adhesion is prevented due to the non-magnetic abutting pieces. Thus, a user can connect the tool onto the screw bolt with the magnet following by slightly rotate the tool to adjust the position of the tool with respect to the screw bolt. Besides, the plural abutting pieces are adapted for screw bolts in various sizes. In addition, during the process of dismantling, the hands of the user may not by contaminated by the greasy screw bolt.

What is claimed is:

1. A screw bolt dismantling tool, including:

a shaft, having a handle and a working portion at two opposite ends thereof, the working portion including a seat and at least one abutting piece, the seat having a magnet on a central portion of a face of the seat opposite to the handle, the abutting piece being located at a periphery of the face of the seat opposite to the handle and extending toward a direction opposite to the handle, the abutting piece being non-magnetic.

2. The screw bolt dismantling tool of claim 1, including two abutting pieces, the two abutting pieces being in interval, an angle between lines defined by each abutting piece and a center of the seat being an acute angle.

3. The screw bolt dismantling tool of claim 2, wherein an end of the seat facing the handle is formed with a connecting notch, the shaft has a protrusion at an end thereof opposite to the handle, the protrusion has a shape corresponding to a shape of the connecting notch to be received in the connecting notch so that the seat is connected with the shaft.

4. The screw bolt dismantling tool of claim 1, wherein the periphery of the face of the seat opposite to the handle is non-magnetic.

5. The screw bolt dismantling tool of claim 1, wherein the seat is detachably disposed on the shaft.

6. The screw bolt dismantling tool of claim 1, wherein the center portion of the face of the seat opposite to the handle is formed with a receiving recess, the magnet has a shape corresponding to a shape of the receiving recess to be disposed in the receiving recess.

7. The screw bolt dismantling tool of claim 1, wherein the abutting piece is column-shaped.

8. The screw bolt dismantling tool of claim 1, wherein the handle is formed with a receiving room at an end thereof opposite to the seat, the receiving room is adapted for receiving tools or working pieces.

9. The screw bolt dismantling tool of claim 1, wherein the shaft is bendable.

10. A screw bolt dismantling tool, including:

a shaft, having a handle and a working portion at two opposite ends thereof, the working portion including a seat and at least one abutting piece, the seat being magnetic, the abutting piece being located at a periphery of the face of the seat opposite to the handle and extending toward a direction opposite to the handle, the abutting piece being non-magnetic.

* * * * *